US006144344A

United States Patent [19]

Kim et al.

[11] Patent Number: 6,144,344

[45] Date of Patent: Nov. 7, 2000

[54] ANTENNA APPARATUS FOR BASE STATION

[75] Inventors: Je-Woo Kim, Kyonggi-do; Kyung-Sup Han; Igor E. Timofeev, both of Suwon, all of Rep. of Korea

[73] Assignee: SamSung Electronics Co., Ltd., Suwon, Rep. of Korea

[21] Appl. No.: 09/208,848

[22] Filed: Dec. 10, 1998

[30] Foreign Application Priority Data

Dec. 10, 1997 [KR] Rep. of Korea ..... 97-67485

[51] Int. Cl.[7] ..... H01Q 1/38; H01Q 21/10

[52] U.S. Cl. ..... 343/770; 343/778; 343/789; 343/700 MS

[58] Field of Search ..... 343/770, 778, 343/795, 700 MS, 789; H01Q 1/38, 13/00, 21/06, 21/08, 21/10

[56] References Cited

U.S. PATENT DOCUMENTS

| | | | |
|---|---|---|---|
| 4,644,362 | 2/1987 | Rammos | 343/778 |
| 4,878,060 | 10/1989 | Barbier et al. | 343/778 |
| 5,061,943 | 10/1991 | Rammos | 343/770 |
| 5,119,107 | 6/1992 | Wildey et al. | 343/770 |
| 5,307,075 | 4/1994 | Huynh | 343/700 MS |
| 5,559,523 | 9/1996 | Smith et al. | 343/795 |
| 5,841,401 | 11/1998 | Bodley et al. | 343/700 MS |

*Primary Examiner*—Michael C. Wimer
*Attorney, Agent, or Firm*—Robert E. Bushnell, Esq.

[57] ABSTRACT

A low cost base station antenna for preventing insertion loss. In the antenna, a printed circuit board (PCB) has a power divider pattern including power divider terminals disposed on one side of the PCB. A conducting ground plate has therein rectangular apertures disposed in line as radiation elements respectively and electromagnetically coupled with each of the power divider terminals of the PCB and disposed to be separated from the PCB by a foamed dielectric sheet with a predetermined thickness so as to be insulated with respect to the power divider pattern. The power divider terminals of the PCB are disposed to terminate within the contour of the apertures and all the power divider terminals are disposed in one line and have a length being a quarter of wavelength. A cavity has a rectangular box with one side open and connected by its open side and by its edges to the ground plate so that all the apertures are disposed within contour of the capacity.

17 Claims, 5 Drawing Sheets

ANTENNA APPARATUS FOR BASE STATION

CLAIM OF PRIORITY

This application makes reference to, incorporates the same herein, and claims all benefits accruing under 35 U.S.C § 119 from an application entitled Antenna Apparatus For Base Station earlier filed in the Korean Industrial Property Office on Dec. 10, 1997, and there duly assigned Serial No. 97-67485 by that Office.

BACKGROUND OF THE INVENTION

1. Field of the Invention

The present invention relates to a planar antenna array, and more particularly, to an antenna apparatus for a base station of a mobile communication system such as cellular (900 MHz), PCS (Personal Communication Services) (1800 MHz) and other wireless communication systems.

2. Description of the Related Art

Planer array antennas are known to come in various forms and have many different purposes. A few examples of such planer array antennas are provided, and incorporated herein by reference, by U.S. Pat. No. 5,061,943 to Emmanuel Rammos and entitled Planar Array Antenna, Comprising Coplanar Waveguide Printed Feed Lines Cooperating with Apertures In A Ground Plane; U.S. Pat. No. 5,307,075 to Tan D. Huynh and entitled Directional Microstrip Antenna With Stacked Planar Elements; and U.S. Pat. No. 5,841,401 to Martin R. Bodley et al. and entitled Printed Circuit Antenna. The 5,841,401 patent has use as a base station antenna in cellular and PCS systems.

An array of cylindrical dipoles used for an early base station antenna is well disclosed in *Mobile Antenna Systems Handbook*, Artech House, 1994, pp. 126–127, by K. Fujimoto and J. R. James. The base station antenna ofthis kind has disadvantages of high production cost, large size and heavy weight.

A printed-array technology makes it possible to construct very thin, light-weight and cost-reduced antennas. An exemplary application of the printed-circuit technology to the base station antenna is presented in Broadband Patch Antennas, Artech House, 1995, by Jean-Francois Zurcher and Fred E. Gardiol. This base station antenna is a vertical linear array with vertical polarization consisting of so-called Strip-Slot-Foam-Inverted Patch (SSFIP) radiators. Functionally, an antenna consists of a microstrip power divider and square patch radiators electromagnetically coupled with it. The patches are coupled to microstrip feed line throw slots, etched in the ground plane of a microstrip line. A foam dielectric layer between the slot and the patch increases the antenna bandwidth. When the antenna is assembled in the sandwich form, it has a lightweight and resistant structure (of a composite material). Mechanically, the antenna has a multilayer structure consisting of a metal ground plate (a.k.a. ground plane), a first printed circuit board (PCB) with a microstrip divider and slots, a foam layer, and a second PCB with patches.

Although the printed base station antenna disclosed in Broad band Patch Antennas is cheaper in comparison with the early cylindrical dipoles, the cost of this antenna is still too high, because the PCBs of the antenna are made from high quality dielectric material to provide low insertion loss in the microstrip power divider. However, even if the high quality and high cost PCBs are used, the insertion loss in microstrip lines may be significant in the electrically big arrays, especially in the high frequency (1.8–2.5 GHz) PCS antenna. With use of this technology, the SSFIP antennas are acceptable for a medium gain (of about 13 dB), but it is still difficult to obtain a high gain (of about 16–20 dB). For example, the insertion loss and gain are 1.5 dB and 12.5 dB, respectively, for the antenna disclosed in Broadband Patch Antennas, despite using a high cost RT/duroid 5870 material for the PCB. Further, for the antenna of a gain 14 dB made by the same technology with the same PCB material, the insertion loss would be about 3 dB, because of an increase by about two times in length of the microstrip line. In the high gain (15–20 dB) antennas, the antenna efficiency is too low for the conventional technology.

Accordingly, the main technical problems of conventional technology are the high production cost and the significant insertion loss. It should be noted that the cost is very important factor for base station antenna because it is a requisite for mass production.

SUMMARY OF THE INVENTION

It is therefore an object of the present invention to provide a low cost base station antenna which can prevent insertion loss.

To achieve the above object, there is provided an antenna apparatus for a base station including a printed circuit board (PCB) having a power divider pattern including power divider terminals disposed on one side of the PCB; a conducting ground plate having therein rectangular apertures disposed in line as radiation elements respectively and electromagnetically coupled with each of the power divider terminals of the PCB and disposed to be separated from the PCB by a foamed dielectric sheet with a predetermined thickness so as to be insulated with respect to the power divider pattern, wherein the power divider terminals of the PCB are disposed to terminate within the contour of the apertures and all the power divider terminals are disposed in one line and have a length being a quarter of wavelength; and a cavity having a rectangular box with one side open and connected by its open side and by its edges to the ground plate so that all the apertures are disposed within contour of the capacity.

BRIEF DESCRIPTION OF THE DRAWINGS

A more complete appreciation ofthis invention, and many of the attendant advantages thereof, will be readily apparent as the same becomes better understood by reference to the following detailed description when considered in conjunction with the accompanying drawings in which.

DETAILED DESCRIPTION OF THE PREFERRED EMBODIMENT

Figure 1:
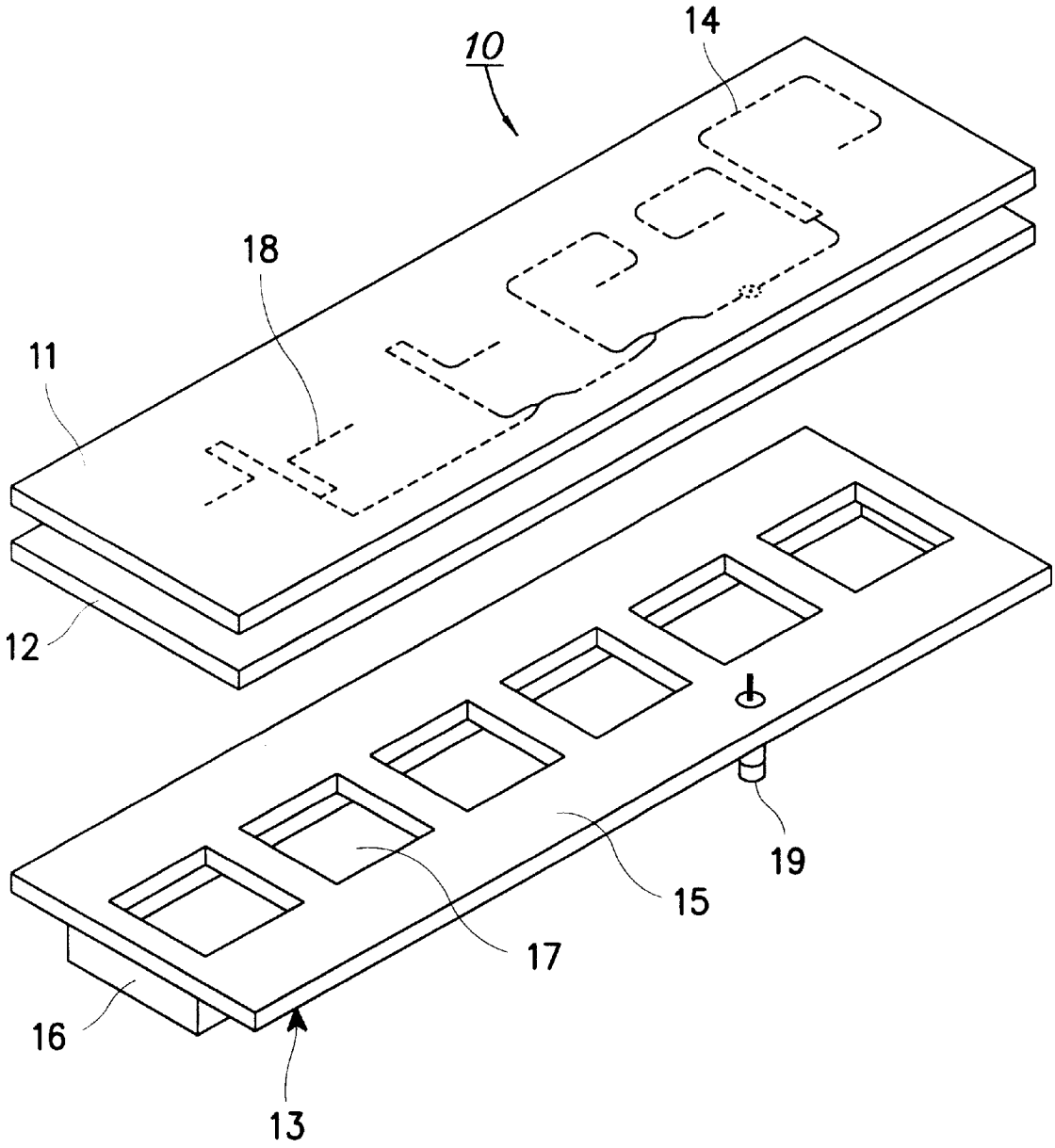
FIG. 1 is an assembly diagram of a base station antenna according to an embodiment of the present invention.
Figure 2:
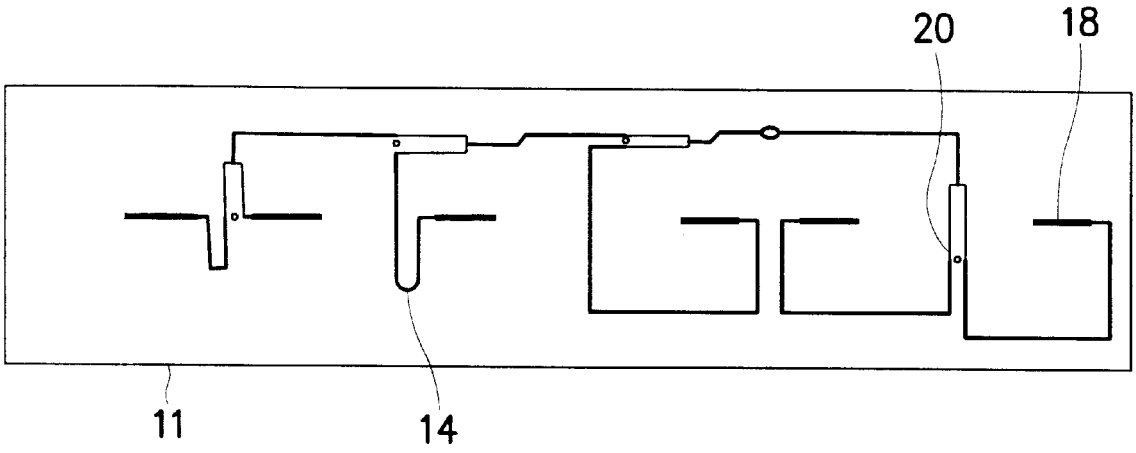
FIG. 2 is a bottom view of a PCB of FIG. 1.
Figure 3:
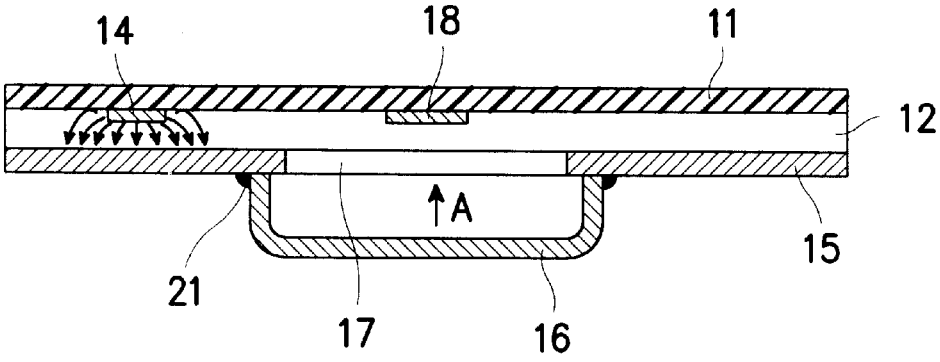
FIG. 3 is a cross-sectional view of the base station antenna according to an embodiment of the present invention.

Referring to FIGS. 1 to 3, an antenna 10 according to an embodiment of the present invention includes a PCB 11 on which a power divider pattern 14 is formed, a foamed dielectric sheet 12 made of polyethylene, and a case 13 consisting of a ground plate 15 and a cavity 16. In the PCB 11, the power divider pattern 14 is a pattern of conducting strips formed by etching on a plastic sheet which is formed with low cost dielectric such as fiberglass (glass epoxy), polypropylene, polyester, acryl or PVC resin with thickness of about 1–1.5 mm. The power divider pattern 14 is etched on the bottom (inner) side of the PCB 11 (see FIG. 2). The foamed dielectric sheet 12 can be formed with foamed polyethylene sheet having the thickness of about 1.5 mm, which is available in the market. The foamed sheet 12 is interposed between the PCB 11 and the case 13. As shown in FIG. 3, the power divider pattern 14 on the PCB 11, together with foam sheet 12 and a ground plate 15, forms an inverted transmission line.

The case 13 is composed of the ground plate 15 and the cavity 16. The ground plate 15 is formed with an aluminum plate having the thickness of about 1.5 mm, and has a plurality of apertures 17 formed, by punching, as radiation elements. An input connector 19 of the antenna 10 is disposed in ground plate 15 of case 13. Arrow A indicates a viewing angle for viewing the relationship of aperture 17 and power divider terminal 18 as shown further in FIGS. 4 and 5. The apertures 17 in the ground plate 15 are formed to have rectangular contours (see FIG. 4) and are arranged in line. The size of the aperture 17 is about 0.5 λ in H-plane and about 0.25–0.5 λ in E-plane. The cavity 16 is a rectangular aluminum box having one side open, and a depth of 0.05–0.25 λ, a width of about 0.5 λ and a length slightly shorter than the length of the antenna 10. The cavity 16 is directly connected (for instance, by weld 21, as shown in FIG. 3) to the ground plate 15, so the line of the apertures 17 coincides with the cavity 16, in the top plane of view.

Figure 4:
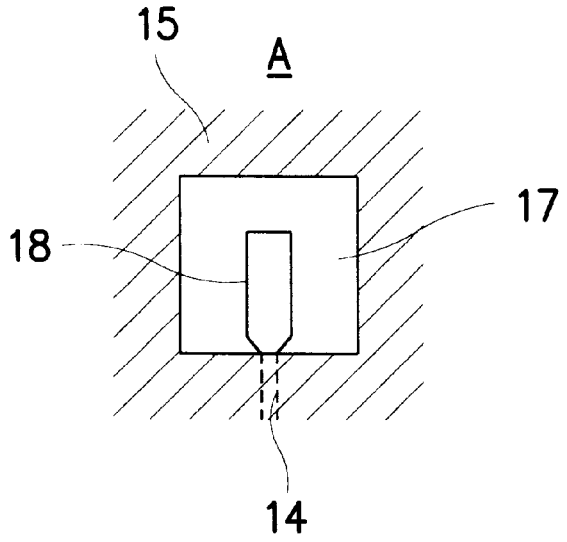
FIG. 4 is a diagram for explaining the relationship between an aperture and a power divider terminal of FIG. 1 according to an embodiment of the present invention.

The power divider pattern 14 on the PCB 11 is so formed as to dispose power divider terminals 18 of the power divider pattern 14 at a position aligned with each of the apertures 17, so that the power divider terminals 18 will extend beyond the center of the aperture 17 in a plan view but terminate at a position within the rectangular contour, without exceeding the contour (see FIG. 4). Further, a highly efficient and low cost PCS base station antenna may be attained when the apertures 17 are formed by punching 6 elements in a column (see FIGS. 1 and 2) at intervals of 100 mm, for example. The distance between the apertures 17 is defined by the following equation (1).

$$d=\lambda_{min}/(1+\sin\epsilon_{max}) \quad (1)$$

where $\lambda_{min}$ is a minimal wavelength, and $\epsilon_{max}$ is an edge angle of a cosecant zone.

Figure 5:
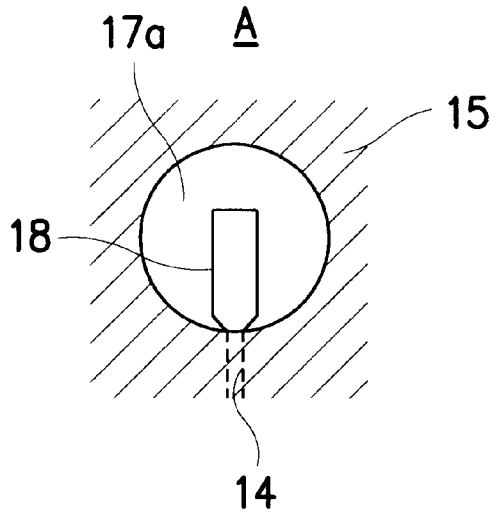
FIG. 5 is a diagram for explaining the relationship between a circular aperture and the power divider terminal of FIG. 1 according to another embodiment of the present invention.

Further, although the apertures 17 are formed preferably to have the rectangular or square contour as shown in FIG. 4 to achieve a larger area for the power divider pattern 14 and to increase width of the radiation pattern in H-plane, they may be formed to have the circular contour, i.e., circular apertures 17*a*, as shown in FIG. 5.

Now, reference will be made to operation of the antenna according to the present invention with reference to FIGS. 1 to 7. In a transmission mode, the power of a base station transceiver 25 is applied to input connector 19 of antenna 10. The transmission line used an inverted line, formed by the power divider, consisting of the PCB 11 with the power divider pattern 14, the foamed dielectric sheet 12 and the ground plate 15, distributes a signal with desirable amplitude and phase between the divider terminals 18. The typical power divider pattern 14 for cosecant beam forming is shown in FIG. 2. The power divider employs elementary dividers as a Wilkinson divider 20 (see FIG. 2). Because an electromagnetic field is concentrated mostly in the foamed dielectric sheet of the inverted line, as shown in FIG. 3, the dielectric loss in the inverted line are virtually equal to zero and the overall insertion loss is much less than that of the microstrip line, even if a high quality dielectric is used in the microstrip line (see K. C. Gupta, *Microstrip Lines and Slotlines*, $2^{nd}$ edition, Artech House, Boston, London, 1996, pp.2–3 and 115–117). As a result, the insertion loss of the antenna 10 according to the present invention is quite lower than that of the conventional antenna.

In the power divider terminal 18, the length is slightly shorter than λ/4 and its operation is similar to a stub (or monopole) radiator (see J. D. Kraus, *Antennas*, $2^{nd}$ edition, 1988, p.421). The cavity 16 and apertures 17 decrease input impedance of this monopole to an acceptable amount of about 50–100 Ω and form an almost symmetrical radiation pattern in E- and H-planes. By changing the length and width of the power divider terminals 18 and the size of apertures 17, it is possible to obtain impedance matching over relatively wide band (of about 10–20%). Thus, the radiation mechanism is as follows: the power divider terminal 18, working as monopole, excites the aperture 17 together with the cavity 16 forming the radiation pattern. The cavity 16 decreases back radiation and increases the front-to-back ratio of the antenna 10, and plays an important mechanical role of supporting the structure of antenna 10.

Figure 6:
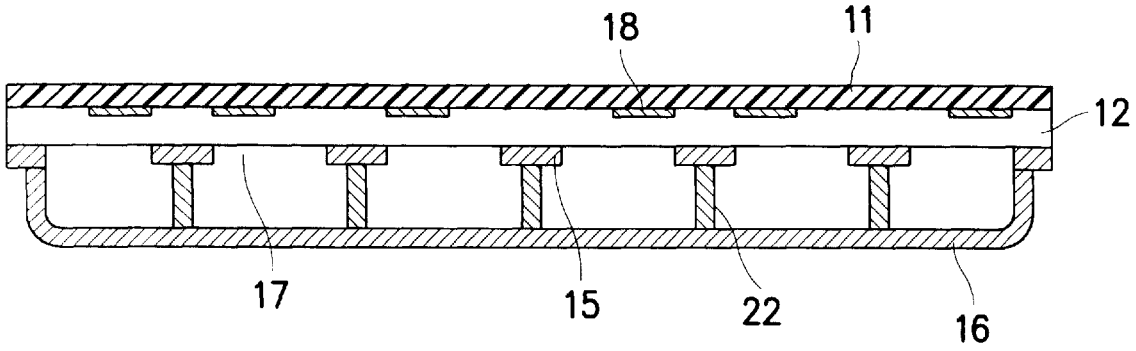
FIG. 6 is a longitudinal cross-sectional view of the base station antenna of FIG. 1.

To reduce mutual coupling between the apertures 17 and consequently to improve radiation pattern synthesis of the antenna 10, it is expedient to make, in the cavity 16, metal lateral partitions 22 between apertures 17, as shown in FIG. 6. The partitions 22 improve the stiffness of the antenna 10, thereby resulting in a reduction in the wall thickness of the cavity 16 and the overall weight of the antenna 10.

The PCB 11 has three functions: a) it serves as antenna radome, b) it supports the power divider pattern 14, c) it gives greater rigidity of the entire antenna 10. In the result, the extremely lightweight, resistant and low profile (about 20–30 mm for the PCS antenna and about 30–40 mm for the cellular antenna) structure is provided. The conductors of the power divider network 14 are well protected from moister and antenna environment by the PCB 11 at one side and the foamed dielectric sheet 12 at the other side, and this provides the high operational reliability of the antenna 10.

Figure 7:
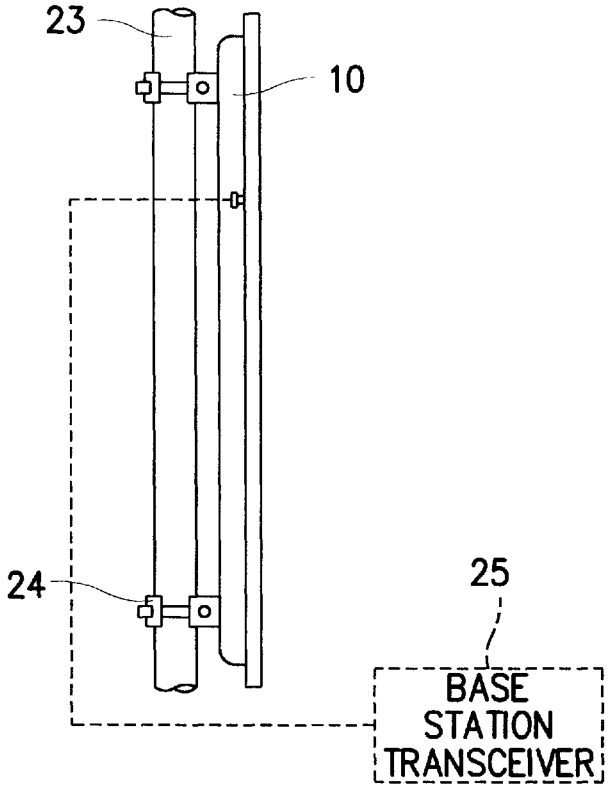
FIG. 7 is a schematic view for explaining operation of the base station antenna according to the present invention.

The base station antenna 10 in the typical operational position is schematically shown in FIG. 7. The antenna 10 is fixed to a mast 23 by clamps 24 and is connected to the base station transceiver 25 as shown in FIG. 7.

Figure 8:
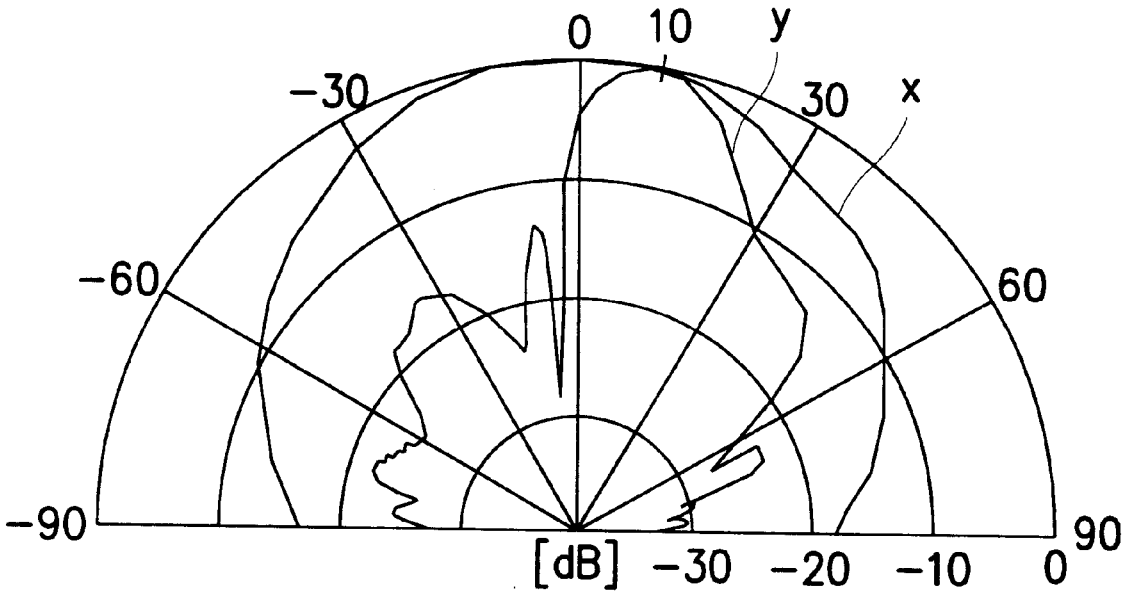
FIG. 8 is a diagram showing a typical radiation pattern of the base station antenna according to the present invention.

Tests have shown wide band performance (about 15%) and improvement of gain (about 0.7 dB) in comparison with an equivalent array made of the conventional technology. FIG. 8 shows typical radiation patterns of the base station antenna of FIG. 1, in which a curve x is the radiation pattern in horizontal plane (sector beam) and a curve y is the radiation pattern in vertical plane (cosecant beam). As can be seen from FIG. 1, the radiation patterns quite easily satisfy a demand for the base station antenna pattern: the horizontal pattern is symmetrical and has appropriate beam width, and the vertical pattern has good coverage of the cosecant zone and low sidelobes.

The present invention has the following effects:

(1) Low Cost

Conventionally, the cost of the PCB accounts for about 70% of the overall antenna cost. The cost of the epoxy glass PCB is lower by about four times than RT/duroid, and the number of the PCBs per antenna is lower by two times. Because the other two parts of invented and conventional antennas are similar (the metal case and the foamed dielectric sheet), the overall cost of inverted antenna can be estimated as only 40% of the cost of conventional antenna.

(2) Low Loss

The insertion loss of inverted line used in the invented antenna can be achieved of about 0.5 dB/m and much less in the 900–1900 MHz band, which is quite better in comparison with the microstrip line (about 1–2.5 dB/m). Thus, the antenna efficiency of the invented antenna is higher than the conventional antenna, especially for the antennas with high gain (15–20 dB).

(3) Low Weight

The weight can be reduced by about 20% in comparison with the conventional antenna, because the invention antenna uses only one PCB.

Another characteristics of invented antenna, as can be seen from FIG. 8, are virtually the same as the characteristics of conventional antenna.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. An antenna apparatus for a base station, comprising:

a printed circuit board (PCB) having a power divider pattern including power divider terminals disposed on one side of said PCB;

a conducting ground plate having a plurality of apertures disposed in line as radiation elements respectively and electromagnetically coupled with each of said power divider terminals of the PCB, wherein said apertures are separated from each other by a distance "d" defined by $d=\lambda_{min}/(1+\sin\epsilon_{max})$, where $\lambda_{min}$ is a minimal wavelength and $\sin\epsilon_{max}$ is an edge angle of a cosecant zone, and said power divider terminals of the PCB are disposed to terminate within the contour of the apertures and all the power divider terminals are disposed in one line and have a length being a quarter of wavelength;

a foamed dielectric sheet, with a predetermined thickness, disposed between the PCB and the conducting ground plate; and a cavity having a rectangular box with one side open and connected by its open side and by its edges to said ground plate so that all the apertures are disposed within a contour of said cavity.

2. The antenna apparatus according to claim 1, wherein said apertures are rectangular.

3. The antenna apparatus according to claim 1, wherein said apertures are circular.

4. The antenna apparatus according to claim 1, wherein said cavity has conducting lateral partitions disposed between said apertures.

5. The antenna apparatus according to claim 1, wherein said foamed dielectric sheet is formed of polyethylene.

6. The antenna apparatus according to claim 1, wherein said power divider pattern is a conducting strip pattern.

7. The antenna apparatus according to claim 1, wherein said foamed dielectric sheet is formed having a thickness of about 1.5 mm.

8. The antenna apparatus according to claim 1, wherein said PCB is formed of a dielectric material having a thickness of about 1–1.5 mm.

9. The antenna apparatus according to claim 1, wherein said power divider pattern utilizes a Wilkinson divider.

10. The antenna apparatus according to claim 2, wherein said apertures have a size of about 0.5 λ in a H-plane and about 0.25–0.5 λ in an E-plane.

11. The antenna apparatus according to claim 1, wherein said cavity is a rectangular aluminum box having one side open, and a depth of 0.05–0.25 λ, a width of about 0.5 λ and a length slightly shorter than a length of said ground plate.

12. The antenna apparatus according to claim 1, wherein said cavity is directly connected to the ground plate by a weld.

13. An antenna apparatus for a base station, comprising:

a printed circuit board having a power divider pattern including power divider terminals disposed on one side of said printed circuit board in one line, each of said power divider terminals having a length being a quarter of a wavelength λ;

a conducting ground plate having therein circular apertures disposed in one line as radiation elements respectively and electromagnetically coupled with each of said power divider terminals of the printed circuit board, wherein said apertures are separated from each other by a distance "d" defined by $d=\lambda_{min}/(1+\sin\epsilon_{max})$, where $\lambda_{min}$ is a minimal wavelength and $\sin\epsilon_{max}$ is an edge angle of a cosecant zone, and said power divider terminals of the printed circuit board are disposed to terminate above respective ones of said apertures and all;

a foamed dielectric sheet, with a predetermined thickness, disposed between said one side of the printed circuit board and the conducting ground plate; and a cavity having a rectangular box with one side open and connected by its open side and by its edges to said ground plate so that all the apertures are disposed above said cavity.

14. The antenna apparatus according to claim 13, wherein said foamed dielectric sheet is formed of polyethylene having a thickness of about 1.5 mm.

15. The antenna apparatus according to claim 13, wherein said printed circuit board is formed of a dielectric material having a thickness of about 1–1.5 mm.

16. The antenna apparatus according to claim 13, wherein said cavity is a rectangular aluminum box having one side open, and a depth of 0.05–0.25 λ, a width of about 0.5 λ and a length slightly shorter than a length of said ground plate.

17. The antenna apparatus according to claim 13, wherein said power divider pattern utilizes a Wilkinson divider.

* * * * *